United States Patent [19]

Baus

[11] Patent Number: 4,974,269

[45] Date of Patent: Dec. 4, 1990

[54] SHOWER BASIN WITH INTEGRALLY FORMED LOWER GUIDE TRACK, PARTICULARLY FOR A CORNER SHOWER

[75] Inventor: Heinz G. Baus, Hünibach-Thun, Switzerland

[73] Assignee: Altura Leiden Holding B.V., Maastrich, Netherlands

[21] Appl. No.: 443,450

[22] Filed: Nov. 30, 1989

Related U.S. Application Data

[62] Division of Ser. No. 202,675, Jun. 6, 1988, Pat. No. 4,903,433.

[30] Foreign Application Priority Data

Jun. 13, 1987 [DE] Fed. Rep. of Germany ..... 3719896
Jan. 14, 1988 [DE] Fed. Rep. of Germany ..... 3800882

[51] Int. Cl.[5] ..... A47K 3/22
[52] U.S. Cl. ..... 4/613
[58] Field of Search ..... 4/557, 607, 613, 614, 4/610, 596; 49/370, 404, 408, 40

[56] References Cited

U.S. PATENT DOCUMENTS

| | | | |
|---|---|---|---|
| 1,574,553 | 5/1924 | Chase . | |
| 2,154,641 | 8/1939 | Seaman | 49/40 |
| 2,948,027 | 8/1960 | Gill | 20/42 |
| 3,422,464 | 3/1966 | O'Brien | 4/154 |
| 4,208,755 | 6/1980 | Shepherd | 49/404 |
| 4,856,126 | 8/1989 | Baus | 4/607 |
| 4,882,795 | 11/1989 | Baus | 4/607 |

FOREIGN PATENT DOCUMENTS

| | | | |
|---|---|---|---|
| 1116986 | 5/1962 | Fed. Rep. of Germany . | |
| 7035597 | 9/1970 | Fed. Rep. of Germany . | |
| 2403386 | 8/1975 | Fed. Rep. of Germany | 4/607 |
| 7806591 | 8/1978 | Fed. Rep. of Germany . | |
| 3309606 | 9/1984 | Fed. Rep. of Germany | 4/596 |
| 1059459 | 3/1954 | France . | |
| 733575 | 5/1969 | France . | |
| 2377792 | 9/1978 | France | 4/607 |
| 2109846 | 8/1983 | United Kingdom | 49/408 |

*Primary Examiner*—Charles E. Phillips
*Attorney, Agent, or Firm*—Foley & Lardner, Schwartz, Jeffery, Schwaab, Mack, Blumenthal & Evans

[57] ABSTRACT

A partition for a corner or circular shower, comprising at least one stationary wall-element adapted to be connected to a wall, at least one guide-rail which on the one hand is connected to the wall-element and is carried by the wall-element, and on the other hand, extends over an entrance-area located at one side of the wall-element, and at least one door-element adapted to move along the guide-rail in order to open and close the entrance-area, this guide-rail and the door-element being curved. At least one pivot-lever has one end hinged to the one door-element, and this pivot-lever, in a closed position of the door-element, lies adjacent, behind and substantially in parallel with the wall-element. The pivot-lever has another end remote from the door-element which is secured to the wall-element.

13 Claims, 13 Drawing Sheets

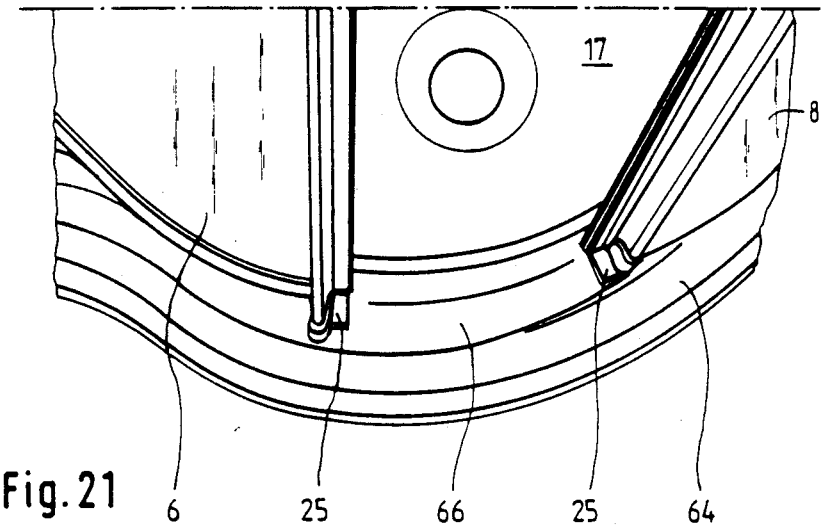
Fig. 21
Fig. 22
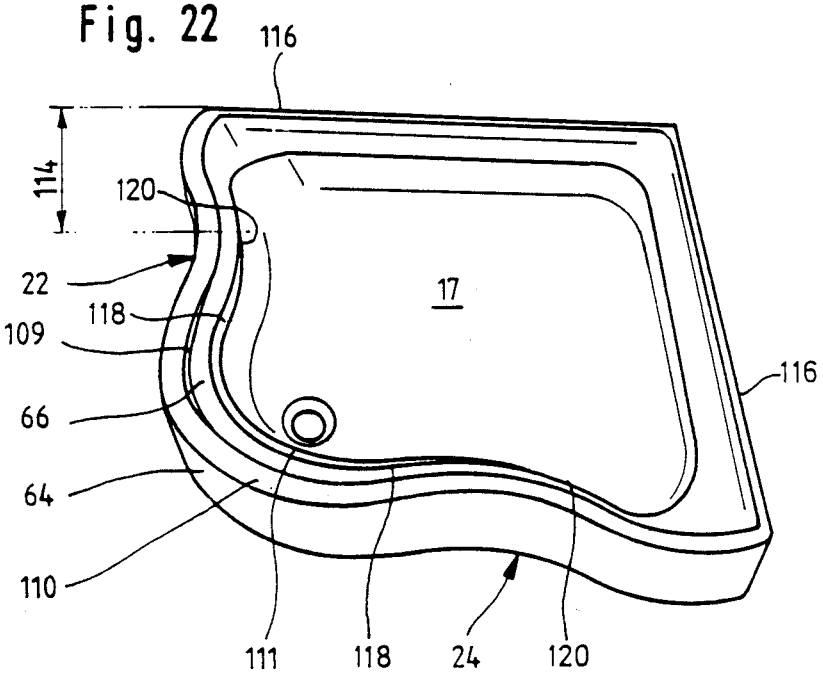

SHOWER BASIN WITH INTEGRALLY FORMED LOWER GUIDE TRACK, PARTICULARLY FOR A CORNER SHOWER

This application is a division of copending application Ser. No. 202,675, filed June 6, 1988, and now U.S. Pat. No. 4,903,433.

BACKGROUND OF THE INVENTION

1. Field of the invention

The present invention relates to a partition, more particularly for a corner- or circular shower.

2. Description of the Prior Art

The German Patent No. 33 09 606 discloses a partition of this kind which may be used in conjunction with a shower-tub which is curved in the entrance-area. Arranged on each side of the entrance-area is a vertical wall-element. These two wall elements are flat and stand upon the edge of the shower-tub which is straight at the sides. A total of four door-elements is provided, each two adjacent door-elements being united by means of resilient seals on their opposing vertical edges. In order to open the entrance-area, the door-elements are pushed aside in pairs behind the flat door-elements. When the entrance-area is closed, the four door-elements constitute a polygon within the entrance-area. The guide-rail is secured to the upper edge of the two wall-elements which, as seen in the horizontal plane, are at right angles to each other. Each door-element is mounted displaceably and suspended, in the guide-rail, by means of separate guide-elements. Each individual door-element has a frame consisting of four profiled rails, the production and assembly of these profiled rails, or frames, for the accommodation of transparent sheets of material, or the like, being relatively costly. Hinging the door-elements together in pairs also involves considerable production and assembly work. In order to achieve reliable and smooth operation, all guide- and door-elements must be accurately assembled and adjusted and this involves additional operations.

OBJECTS OF THE INVENTION

It is an object of the present invention to develop a partition, at low structural cost in such a manner that it may also be used for shower-tubs or the like in which arcuate or undulating areas exist outside the entrance-area also. The partition is also to be designed, at low cost, for shower-tubs having undulating or multiple-curve edges. It is to be a simple matter to adapt the partition to shower-tubs or other areas which are differently shaped. It is to be possible, with a simple design, to provide, between the middle of the entrance-area and the outer edge, a bend or curve directed towards the interior of the shower-tub. At the same time, accurate and reliable guidance, and stable suspension of the door-element, is to be assured. The most accurate possible vertical suspension and alignment of the door-element is to be achieved simply, with few components, and assembly costs are to be low. It is also to be possible for any subsequent adjustments to be carried out without difficulty by an unskilled person. The design of the partition is also to be attractive and satisfactory reliability and stability are to be assured with few components.

The partition according to the invention provides a stable and reliable design, the pivot-lever ensuring smooth operation of the door-element even if the guide rail and door-element have multiple curves.

SUMMARY OF THE INVENTION

According to the present invention there is provided a partition for a corner or circular shower, comprising:

at least one stationary wall-element adapted to be connected to a wall, at least one guide-rail which on the one hand is connected to said at least one wall-element and is carried by said wall-element, and on the other hand, extends over an entrance-area located at one side of said wall-element, at least one door-element adapted to move along said guide-rail in order to open and close said entrance-area, said guide-rail and said door-element being curved;

at least one pivot-lever having one end hinged to said at least one door-element, said pivot-lever, in a closed position of the door-element, lying adjacent, behind and substantially in parallel with said at least one wall-element, said pivot-lever having another end remote from said door-element secured to said wall-element.

Preferably, the at least one door-element is adapted to move along the guide-rail by means of a guide-body, the one end of the at least one pivot-lever is hinged to said at least one door-element in the vicinity of an outer longitudinal edge of the door-element, and the another end of said at least one pivot-lever is pivotally secured to said wall-element by means a of bearing-support.

Preferably, the another end of said at least one pivot-lever is pivotally secured to the wall-element through the guide-rail which extends over the entire width of the at least one wall-element, the guide-rail being located behind the wall-element when looked from outside into an interior space delimited by the partition.

According to the present invention, one of the hitherto usual guide-bodies of the door-element is replaced by the above mentioned pivot-lever.

Depending upon the size and arrangement of the pivot-lever, the door-element may pivot away from the wall-element and the guide-rail when the entrance-area is closed or opened. This is in contrast to existing partitions having sliding doors in which, by means of the two guide-bodies, the relative position of, and the distance between, the door-element and the guide-rail may be predetermined unchangeably.

It has now become possible, in a surprisingly simple manner, to provide the guide-rail, as well as the door-elements, with undulations or bulges without in any way restricting the mobility of the door-element. Thus the guide-rail, and at least a part of the door-element, preferably, have bulges directed towards the interior.

The partition can be adapted, without difficulty, to an undulating or wave-form configuration of the edge of a shower-tub or the like, corresponding to the bulge and to the curved entrance-area.

It is preferable to provide two stationary wall-elements which exhibit, as seen towards the middle of the entrance-area, bulges similar to the guide-rail and possibly to the edge of the shower-tub.

The two door-elements may also have an undulating configuration. Although the symmetrical design, having two wall-elements and two door-elements adapted to slide behind them, has been found particularly satisfactory, the invention also covers designs having only one door-element or one wall-element.

The present invention also covers a design having two lateral wall-elements and one door-element which is adapted to be moved and pivoted behind the one of the wall-elements.

Preferably, the door-element, on the one hand, is adapted to be displaced in the guide-rail by a guide-body and, on the other hand, it is mounted pivotably, by means of the pivot-lever, in relation to the guide-rail and/or the wall-element.

The guide-rail is preferably mounted at the top on the wall-elements and is connected thereto. However, a lower guide-rail may also be provided and can be integrated into the edge of a shower-tub.

Only one pivot-lever per door-element is needed and this may be hinged at will to the top and/or the bottom of each door-element. For reasons relating to stability, the pivot-lever is hinged to the outer end of the door-element, preferably to the vertical profiled rail thereof.

A bearing part, or an axis of the pivot-lever on the door-element, is preferably at a distance, in the closed position, from a connecting line running between the guide-body and the hinge-point, or bearing-support, of the pivot-lever on the stationary wall-element or the guide-rail. This distances ensures that, when the doors are opened, the pivoting movement can be initiated without any difficulty, without having to pass through a "dead-point" or having to move the pivot-axis or the bearing-part over such a "dead-point". This is a reliable way of ensuring that the doors open smoothly. Moreover, in view of the relationship indicated, the bearing-part or pivot-axis will also exhibit a corresponding distance in the open position, again in order to avoid such a "dead-point" which would impair the smooth operation and mobility of the door-element.

In a preferred embodiment, the partition and a shower-tub on which it may rest are matched so that a separate lower guide-rail is unnecessary. To this end, the bottom of the door-element carries guide-elements and the front edge of the shower-tub is provided with an upwardly open guide-channel in which the guide element engages. This particular partition is characterized by its stable and reliable design, guidance of the door-element being effected directly by the guide-channel on the shower-tub. The guide channel is produced in the same operation as the shower-tub, so that scarcely any additional production or material costs are involved. The guide-channel is an integral part of the shower-tub and the edge of the latter may be of a very wide variety of shapes. The guide-channel is located behind a front part of the edge, the upper part of which is higher than the guide-channel itself. An inner part having an inner edge adjoins the guide-channel, the inner edge preferably being lower than the said upper part of the front part of the edge. This still further facilitates passage through the entrance-area. The upwardly open guide-channel preferably has a rounded upper surface which, on the one hand, facilitates production and, on the other hand, reduces the danger of contamination. The guide-channel also stiffens and stabilizes the edge of the tub. This is of particular advantage in producing a shower-tub preferably made of plastic by the deep-drawing process, since satisfactory stability is assured, even if the walls of the tub are relatively thin. The guide-element engaging in the guide-channel is preferably narrow in the longitudinal direction of the edge of the tub and is preferably arranged in a vertical profiled rail of the door-element. The guide-channel eliminates the need for the hitherto usual lower guide-rail, thus ensuring unimpeded passage through entrance-area. The elimination of a separate lower guide-rail reduces the amount of material required for the partition and the weight thereof. Furthermore, hygienic requirements are met in a satisfactory fashion since the corners, seal-joints and the like in the lower guide-rails are eliminated and the guide-channel, integrated into the shower-tub may easily be designed with rounded edges.

BRIEF DESCRIPTION OF THE DRAWINGS

Preferred embodiments will now be described, as examples without limitative manner, having reference the attached drawings, wherein:

FIG. 21 is an oblique view from above of the guide-channel in the entrance-area;

FIG. 22 is a perspective view of the shower-tub and guide-channel in the entrance-area.

DESCRIPTION OF AN EXEMPLARY EMBODIMENT

Figure 1:
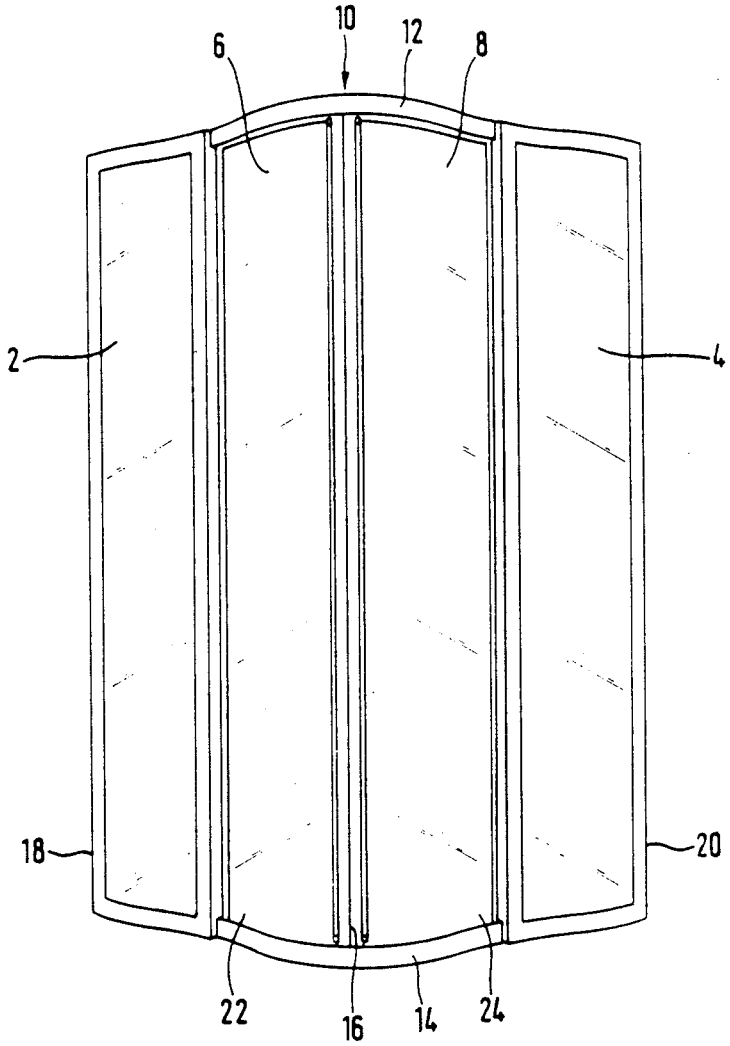
FIGS. 1–3 are views of the partition with two door-elements, the entrance-area being completely closed, partly open and fully open.
Figure 2:
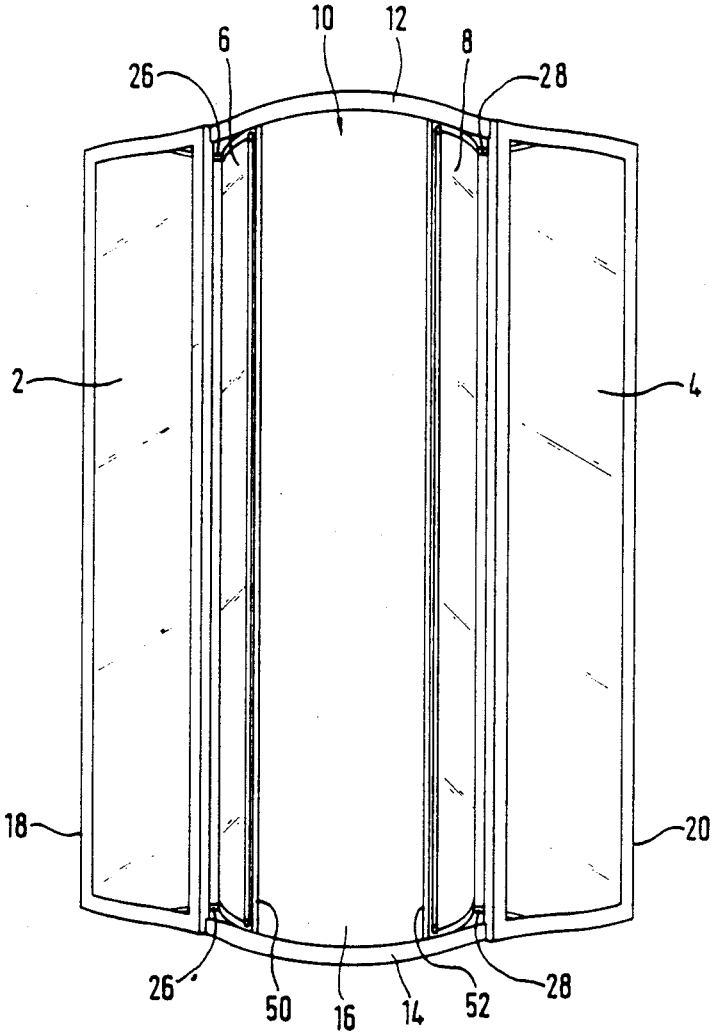
Figure 3:
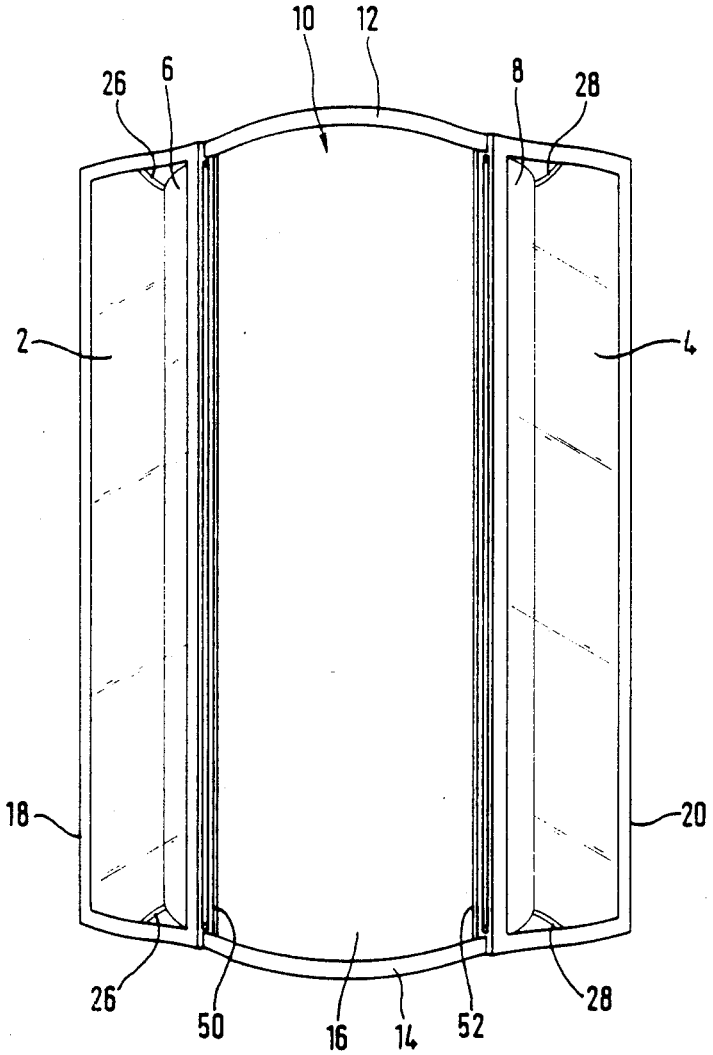

FIGS. 1 to 3 illustrate the partition comprising two lateral, stationary wall-elements 2,4 and two door-elements 6,8 for the purpose of closing or opening an entrance-area 10. There is an upper guide-rail 12 which is secured at the upper edge of the wall-elements 2,4 to the horizontal profiled rails thereof. There is also a lower guide-rail 14 for the two door-elements 6,8. According to the invention, this lower guide-rail 14 may be omitted or possibly integrated into the edge of a shower-tub or into the floor, not shown here. As shown, the two guide-rail 12,14 are curved, in entrance-area 10, forwardly into the exterior; each of the guide-rails 12,14 comprises, between the middle 16 of the entrance-area 10, and the outer edges 18,20 of the wall-elements 2,4, or the vertical profiled rails located there, an inwardly directed bulge 22,24. The wall-elements 2,4 are arranged substantially at right angles to each other; at the outer edges 18,20 they are connected to the walls of the room; these walls, not shown, are also arranged at right angles to each other, so that a substantially rectangular or square interior is formed, in the usual way, behind the partition. The guide-rails 12,14 exhibit an undulating or wave-form configuration corresponding to the curvature in entrance-area 10 and to bulges 22,24. The wall-elements 2,4 and the door-elements 6,8 are adapted to such undulating configuration. A similar undulating partition may be placed upon a correspondingly undulating edge of a shower-tub, or also directly upon the floor of a shower-room or the like, with lower guide-rail 14.

Although, because of its symmetrical design, the partition described above has been found particularly satisfactory, the invention also covers designs having only one door and/or only one wall-element. In many cases, two lateral wall-elements, and only a single door-element, may be found desirable. In this case, the width of the entrance-area, and eventually that of the door-element, may be equal to the width of the two door-elements. Common to all of these designs is the fact that the door-elements, especially in the vicinity of the one vertical longitudinal edge, is guided in a guide-rail, in the usual manner, with a guide-body and, in the vicinity of the other vertical longitudinal edge, it is hinged by means of a pivot-lever which is hinged in turn to the door-rail and/or to the stationary wall-element. Finally, and according to this invention, the pivot-lever may, if necessary be hinged or secured to one wall of the room by means of a bearing-support or the like.

Figure 4:
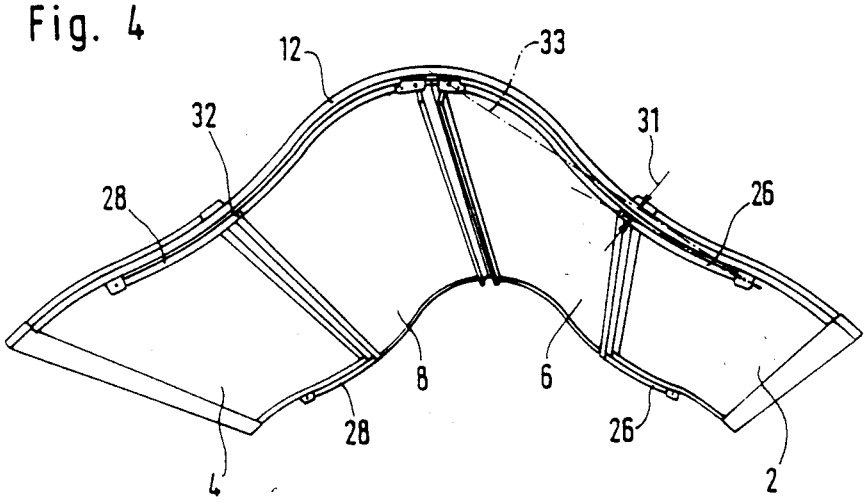
FIGS. 4, 5 are perspective views of the partition from above, with the door-elements closed and open.
Figure 5:
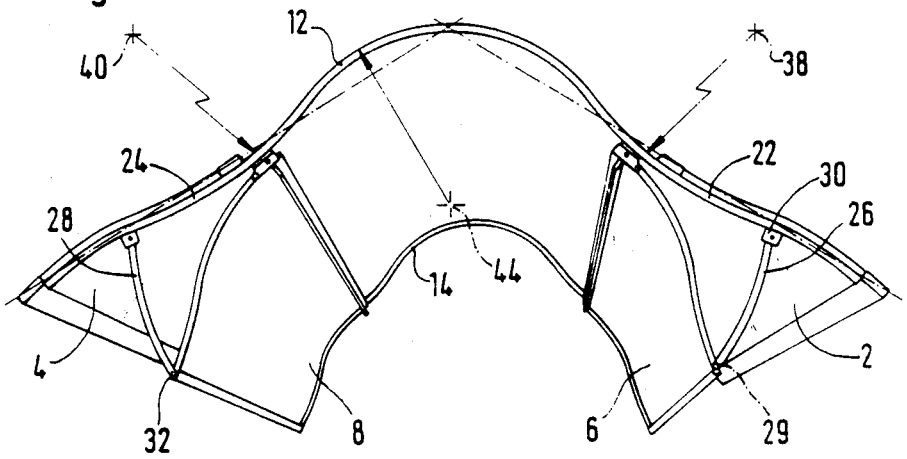

The perspective views in FIGS. 4 and 5 show quite clearly the undulating design of the guide-rails 12,14, of the wall-elements 2,4 and of the door-elements 6,8. Because of this undulating design, simple displacement of the door-elements 6,8 along the guide-rails 12,14 is impossible. As may easily be seen from FIG. 4, simple displacement of door-elements 6,8 would result in jamming after a small amount of opening movement. For this reason, at least one pivot-lever 26,28 is provided for each door-element 6,8. In the Figures there are seen two pivot-levers for each door-element, namely behind upper guide-rail 12 and behind lower guide-rail 14. However, basically a single pivot-lever, either at the top or at the bottom, is sufficient, but two have been found desirable from the point of view of stability and smooth operation. When the door-elements 6,8 are closed, pivot-levers 26,28 run in parallel with the guide-rails 12,14 and are preferably at least fairly close to them.

The end of each pivot-lever 26,28, remote from its associated door-element 6,8, is secured to a corresponding guide-rail 12,14 by means of a bearing-support 30. In the case of the partition shown, the guide-rails 12,14 extend over the entire width of the shower-separation, i.e. over both entrance-areas 10 and over lateral vertical wall-elements 2,4. The pivot-levers 26,28 are hinged, at the upper and lower ends, in the vicinity of outer longitudinal edges 54,56 by means of bearing-parts 32, to door-elements 6,8. The axis 29, at the hinge-point of the pivot-lever 26,28 on the door-element 6,8, is at a distance 31 from a connecting line 33 which runs between the guide-body, to be explained hereinafter, of the door-element 6,8 and the bearing-support 30. This distance, predetermined according to the invention, ensures that, at the beginning of the opening movement, the pivot-axis is not at the "dead-point". This allows the pivoting movement to take place very easily, thus ensuring smooth operation and easy handling of the door-element. The distance 31, predetermined according to the invention, increases, at least at the beginning of the opening movement.

Although this provides satisfactory stability, it is possible, in the case of an alternative design, not shown here, for the guide-rails 12,14 to extend substantially over entrance-area 10 only. In this alternative design, it would be necessary to secure bearing-supports 30 directly to wall-elements 2,4 in a suitable manner. Each door-element 6,8 also comprises a bearing-part 32 which effects the hinging of pivot-lever 26,28. The bearing-part 32 is preferably secured at the outer end of the relevant door-element, more particularly in the vertical profiled rail 13,15 of the door-element 6,8 and this ensures satisfactory stability. On the other hand, the bearing-support 30 is secured substantially centrally of the wall-element 2,4.

FIG. 5 shows clearly the curved design of the pivot-levers 26,28 corresponding to bulge 22,24. Broken lines 34 indicate that the two wall-elements are arranged substantially at right angles to each other. The centre 38,40 of undulating bulge 22,24 is located, according to the invention, in the exterior, whereas the centre 44 of the arc of entrance-area 10 is located in the interior space 36. It is to be understood that, both the size and the location of the bulges, and the centres thereof, may be adjusted as required, reliable guidance of the door-elements being assured by means of the pivot-levers 26,28. Even in the open position, the pivot-axis 29 is outside the "dead-point", allowing the closing movement to be initiated reliably and with little effort. The distance is desirably at its greatest in the opened position, at least approximately. This ensures that, during closing, little or no pressure is to be transferred through pivot-lever 26,28 to the bearing-support 30. In other words, the force applied is used almost entirely to move the doors and no force-components will arise to impair smooth operation.

Figure 6:
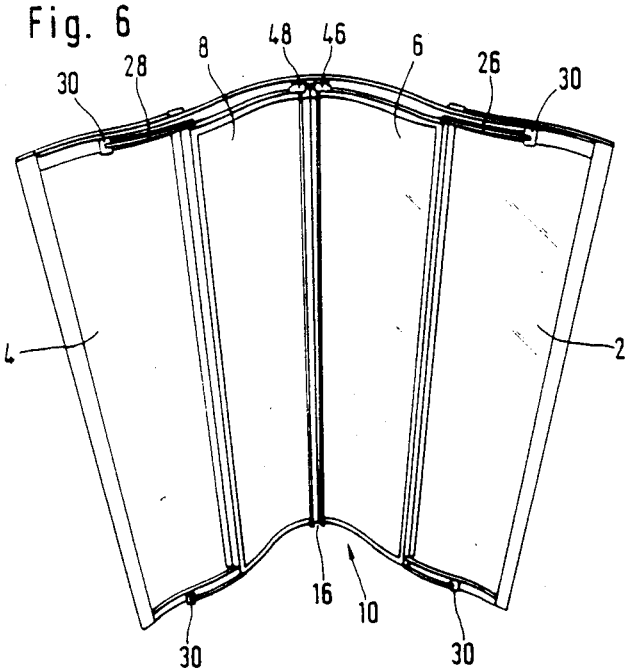
FIG. 6 is a view similar to that of FIG. 4.

FIG. 6 shows the partition as in FIG. 4, with guide-bodies 46–48 clearly visible. These guide-bodies are of known design and are arranged at central front edges 50,52, guide-rollers, not shown here, being provided in the upper guide-rail 12. Hooked slides are associated with lower guide-rail 14, also in the vicinity of central front edges 50,52, the slides engaging in the track of lower guide-rail 14. The bearing-supports 30 are secured, by means of screws to the relevant guide-rails, approximately centrally of the wall-elements 2,4.

Figure 7:
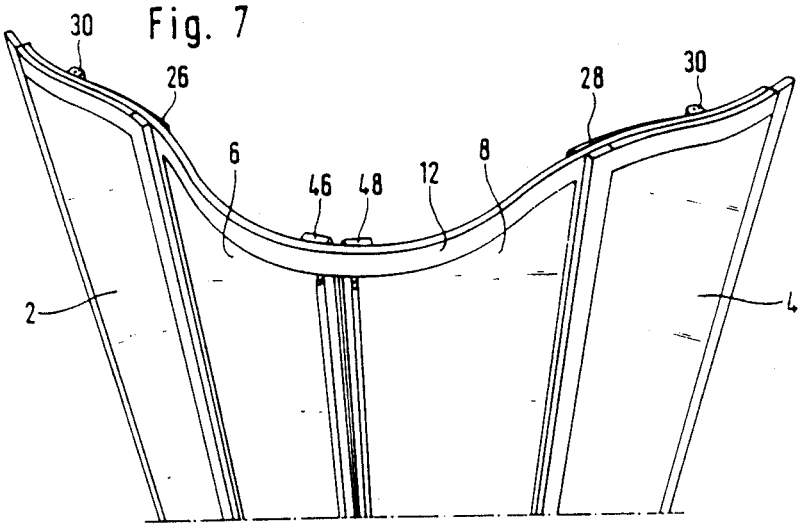
FIG. 7 is an enlarged view of the upper part of the partition with closed door-elements.

The enlarged representation in FIG. 7 of the upper part of the partition shows quite clearly that undulating upper guide-rail 12 matches wall-elements 6,8. Like the bearing-supports 30, the pivot-levers 26,28 are located behind the guide-rails 12,14, the upper pivot-levers 26,28 being arranged over the top edge of the door-elements 6,8. The lower pivot-levers are arranged accordingly below the bottom edge of the door-elements.

Figure 8:
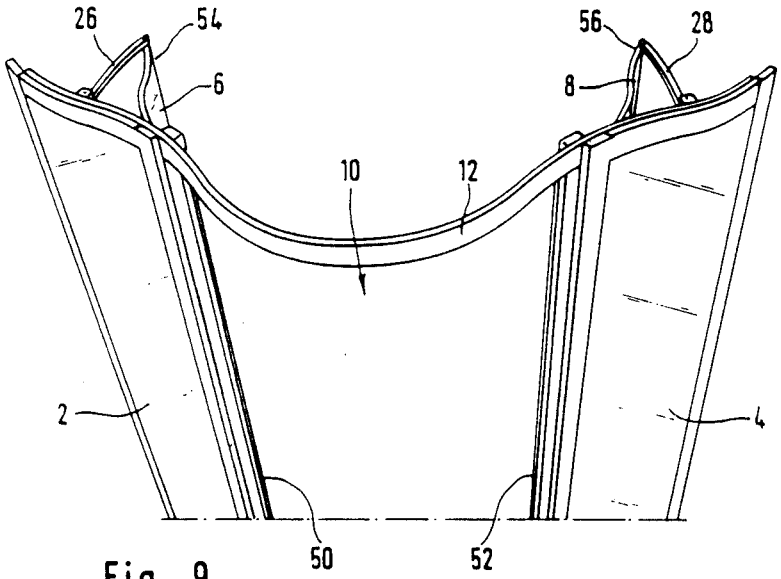
FIG. 8 is a view according to that of FIG. 7, but with open door-elements.

FIG. 8 shows, to an enlarged scale, the upper part of the partition, with the door-elements 6,8 in the fully open position. The pivot-levers 26,28 project into the interior 36, as do the outer ends of the door-elements 6,8. In this position, the outer longitudinal edges 54,56 of the door-elements 6,8 are at a distance from the guide-rail 12 which is defined by the length of pivot-lever 26,28.

Figure 9:
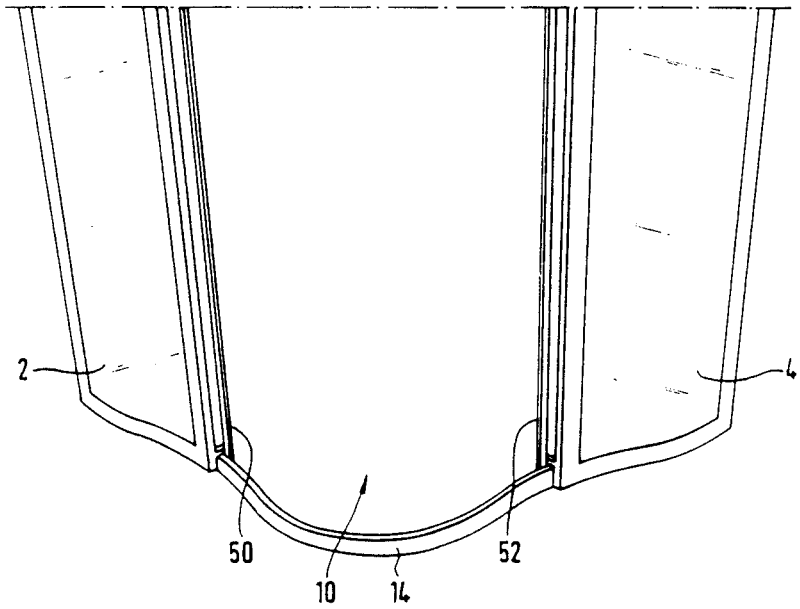
FIG. 9 is a view of the lower part of the shower-partition with open door-elements.

FIG. 9 shows the lower part of the partition, with the door-elements 6,8 pushed aside behind stationary wall-elements 2,4. The entrance-area 10, at the lower end of which the curved lower guide-rail 14 is located, is fully open. All that can be seen of the door-elements 6,8 are the vertical profiled rails 13,15 with central front edges 50,52. As already indicated, the lower guide-rail 14 may be seated upon the similarly undulating edge of a shower-tub. Since the lower edges of the two door-elements 6,8 are arranged behind the lower guide-rail 14, splashes cannot escape when the door-elements are closed. However, as an alternative, the lower guide-rail 14 may be omitted, so that the user enters the interior practically in the same plane. Suitable seals may be provided along the lower edges of the door-elements 6,8, in order to prevent the escape of water.

Figure 10:
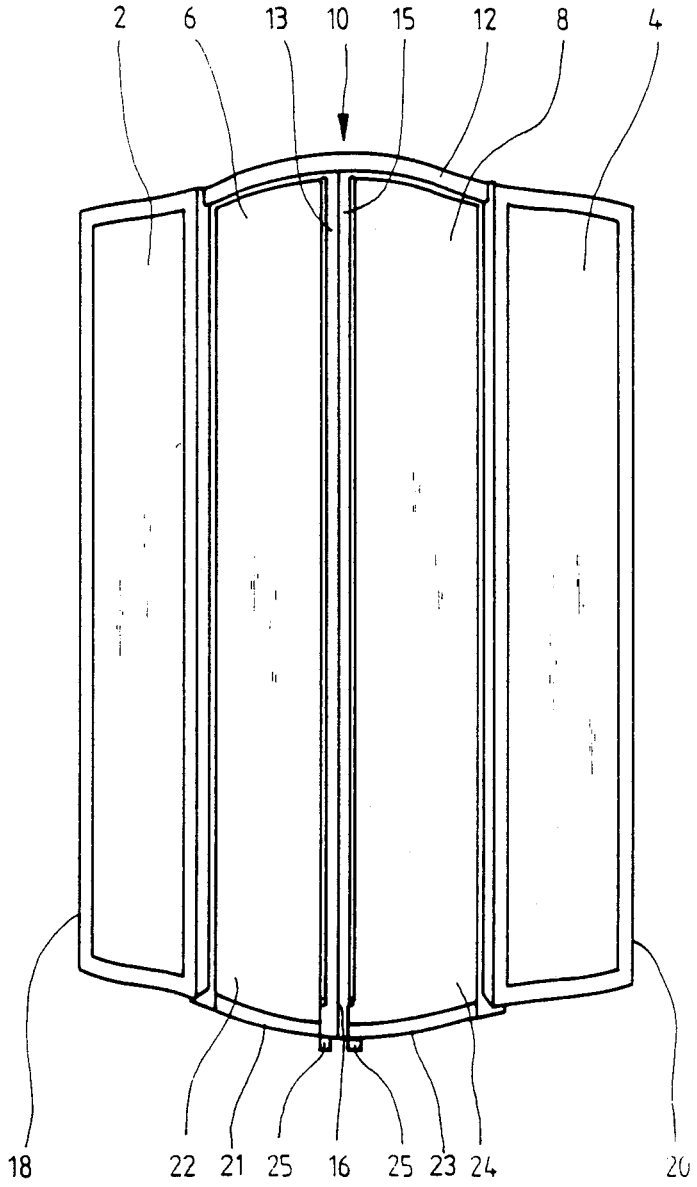
FIG. 10 shows a special configuration of the partition with no lower guide-rail.

FIG. 10 shows a special configuration of the partition without a lower guide-rail. The door-elements 6,8 are longer than stationary wall-elements 2,4 and lower edges 21,23 of the door-elements 6,8 are at a lower level than stationary wall-elements 2,4. The front edge of a corresponding shower-tub comprises, at least in the entrance-area, an upwardly open guide-channel in which a guide-element 25 of the relevant door-element 6,8 engages from above. The guide-elements 25 are preferably arranged below opposing vertical profiled rails 13,15 of the door-elements 6,8.

Figure 11:
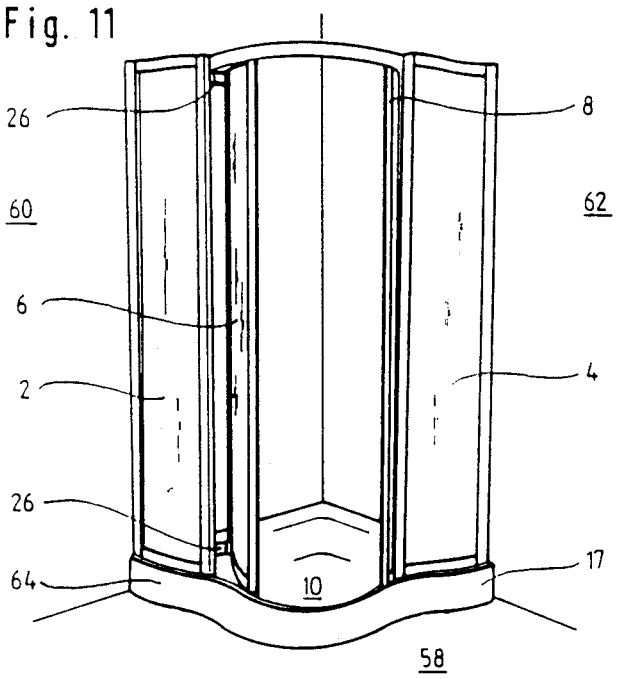
FIG. 11 is a view of the partition according to FIG. 10 with a shower-tub.

FIG. 11 is a front elevation view of the partition, together with a shower-tub or shower basin 17. The latter is installed upon floor 58 of a bathroom or shower-room, in the corner between walls 60,62 of the room which are at right-angles to each other. The front wall portion 64 of the tub 17 undulates to correspond to the above-mentioned bulges 22,24. The door-elements 6,8 are pushed partly behind the wall-elements 2,4 in order to leave entrance-area 10 open. Pivot-levers 26, to be hinged to wall-element 2, may be seen in part on the left-hand door-element in the drawing.

Figure 12:
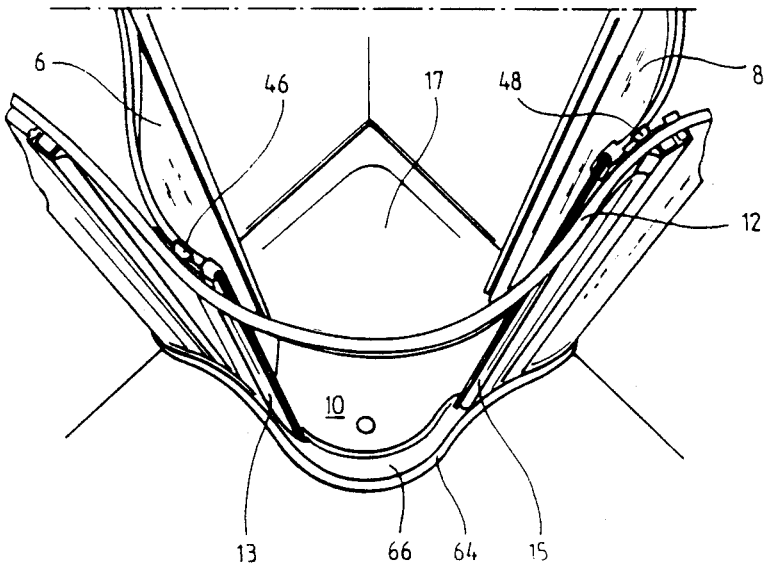
FIG. 12 is a view of the partition from above with the shower-tub according to FIG. 11.

FIG. 12 is a view of the partition from above, with the door-elements 6,8 pushed aside and the entrance-area 10 fully open. Upwardly an open guide-channel 66 may be seen in front wall portion 64 of the shower-tub 17, the guide-channel 66 being a part of the shower-tub. As seen in FIG. 12, viewed from above, guide channel 66 is substantially in the form of a circular arc. Located at the top of the door-elements 6,8, in the vicinity of the vertical profiled rails 13,15, are the guide-bodies 46,48 by means of which the door-elements 6,8 are suspended displaceably in the upper guide-rail 12. As can be seen in FIG. 12, the central entrance region extends substantially circularly through an angle of at least 90 degrees.

Figure 13:
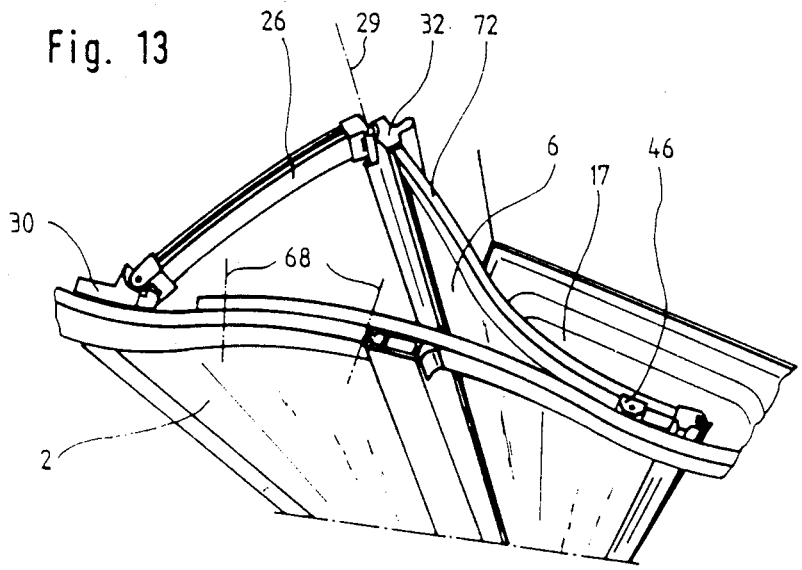
FIG. 13 is an enlarged view of a part of the partition from above.

FIG. 13 is a view of the partition from above, to an enlarged scale, with the door element 6 not yet pushed completely behind wall-element 2. The door-element 6 is hinged, along the edge facing the wall of the room, by means of a pivot-lever 26 and a bearing-support 30, to a wall-element 2. The lower end of the door-element 6 is also hinged to the wall-element 2. The upper guide-rail 12 does not extend over the entire width of the wall-element. Instead it ends substantially in the middle thereof, a firm connection being provided by means of screws indicated by lines 68. By means of a bearing part 32 of the door-element 6, the pivot-lever 26 is arranged to pivot in relation to the vertical axis 29. The same applies to the other door-elements.

Figure 14:
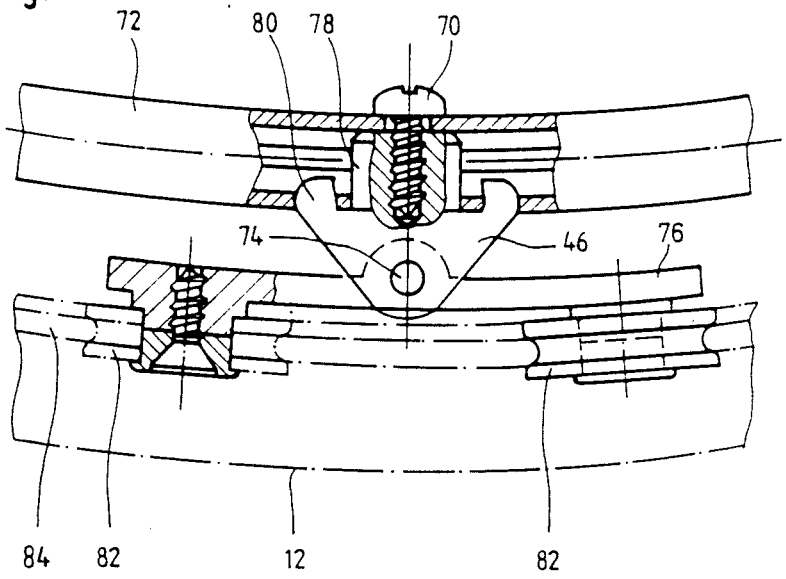
FIG. 14 is a view, and partial cross-section of the upper guide-rail in the vicinity of the guide-body.

FIG. 14 is a view, to an enlarged scale, in part section, and from above, of a guide-body 46 which is secured, by means of a screw 70, to the upper profiled rail 72 of the door-element 6. The guide-body 46 is secured against rotation so that the axis 74 can be relied upon to remain vertical. A rocker 76 is arranged to pivot upon the guide-body 46 about axis 74. The guide-body 46 comprises a central part 78 which engages in a bore in the upper profiled rail 72 of the door-element 6 and into which the screw 70 is screwed. In order to prevent rotation, the top of the guide-body 46 carries a supporting part 80 which rests upon the upper edge of profiled rail 72 of the door-element 6. A guide-roller 82 is arranged to rotate at each end of the rocker 7. These guide-rollers 82 engage from behind in a guide-groove in upper guide-rail 12 where they may roll upon a track 84. This arrangement with the guide-rollers 82 ensures stable suspension of the door-element 6. In combination with the previously mentioned pivot-levers 26,28, this allows the door-elements to swing open and to be guided along the undulating guide-rail 12.

Figure 15:
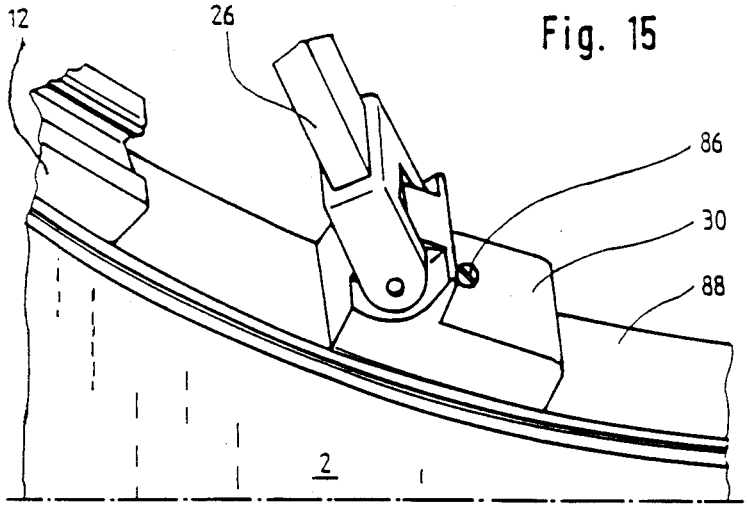
FIG. 15 is a view from below of the pivot-lever bearing-support.
Figure 16:
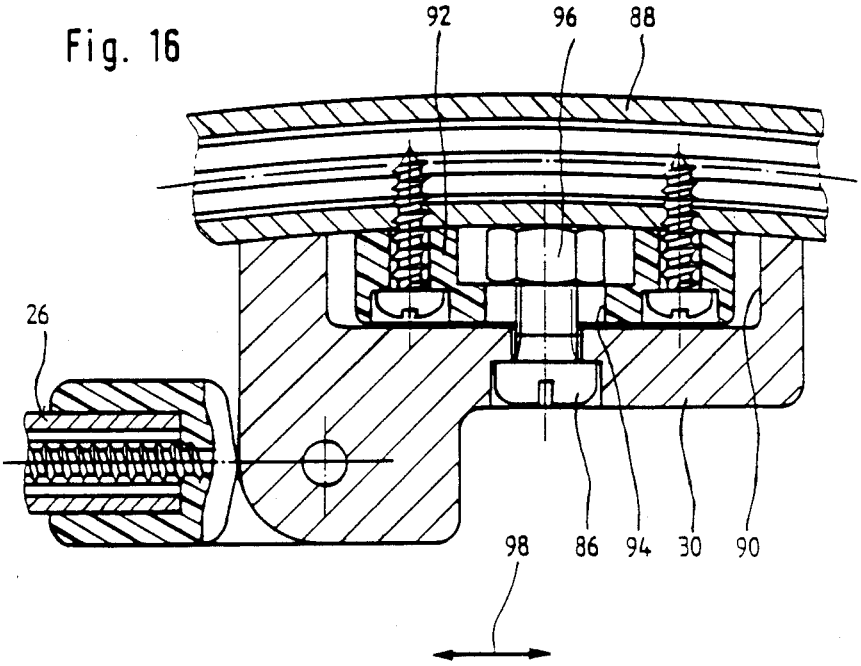
FIG. 16 is a horizontal section through the bearing-support illustrated in FIG. 15.

FIGS. 15 and 16 show a bearing support 30 in a horizontal cutting plane, together with an adjusting screw 86. The bearing support 30 comprises a recess 90, open towards upper section 88 of the wall-element, in which an intermediate part 92 is arranged. This intermediate part 92 is secured to section 88 by means of screws. The intermediate part 92 also comprises an elongated hole 94 running horizontally, through which the adjusting screw 86 passes. It is to be understood that if this elongated hole, arranged here horizontally, is appropriately designed and arranged, horizontal adjustment is also possible. The end of adjusting screw 86 is screwed into a nut 96 arranged in the intermediate part 92. The bearing-support 30 is thus adjustable, in the direction of double arrow 98, by loosening and tightening screw 86. If the elongated hole 94 is suitably designed, vertical adjustment of the bearing support 30 is also possible if required.

Figure 17:
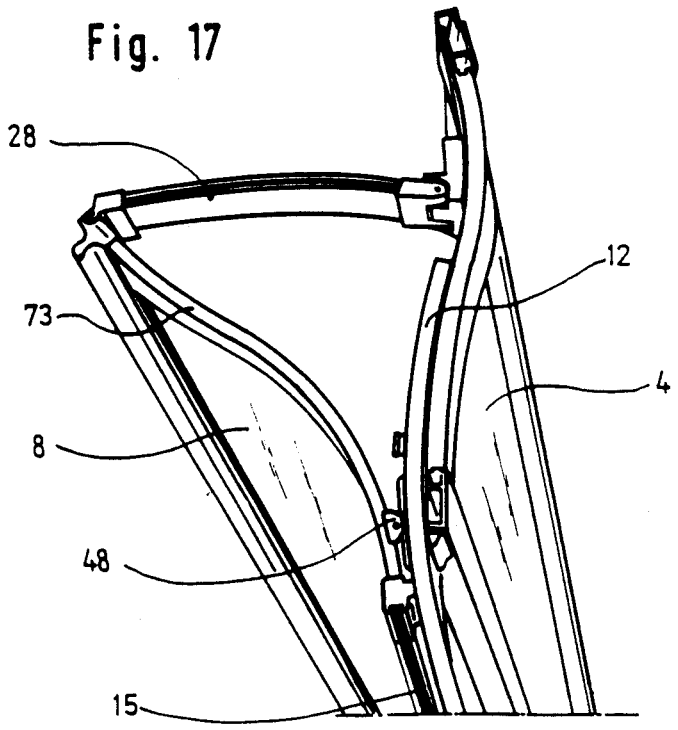
FIG. 17 is a view of a door-element from above with the entrance-area open.

FIG. 17 is a view from above of the other door-element 8 and of the guide-rail 12 with the door-element 8 in the open position. As in the case of the door-element 6 described hereinbefore, the door-element 8, on the one hand is guided in the upper guide-rail 12 by means of guide-body 48 and, on the other hand is hinged to the wall-element 4 by means of a pivot-lever 28. In the closed condition, the pivot-lever 28 is in direct extension of the upper horizontal profiled rail 73 of the door-element 8 and it runs substantially in parallel with the upper guide-rail 12.

Figure 18:
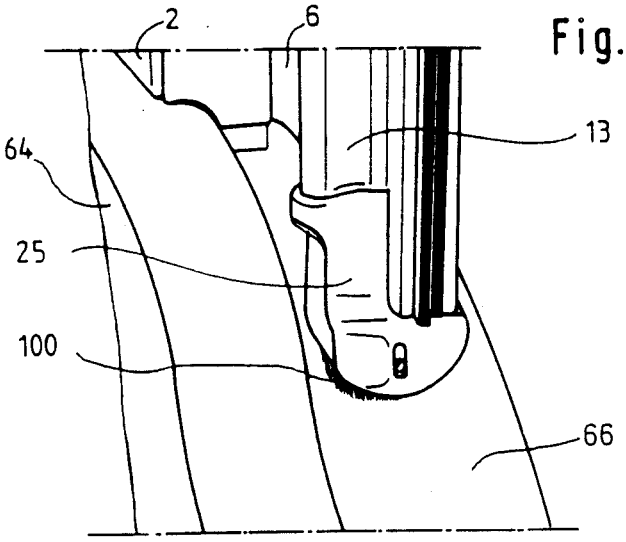
FIG. 18 shows a guide-element engaging in a guide-channel.

FIG. 18 shows a part of the front wall portion 64 of the shower-tub 17 with the guide-channel 66. The bottom of a guide-element 25 constitutes an extension of vertical profiled rail 13 of door-element 6. All that can be seen of the wall-element 2 is the lower end of the vertical section defining the entrance-area. Guide-channel 66 is upwardly open and is concave. Arranged at the lower end of the guide-element 25 is a small flexible brush 100 comprising a plurality of hairs or fibres resembling a brush-seal. The brush is vertically displaceable in the guide-element 25. This is a reliable way of compensating for possible inaccuracies and providing satisfactory guidance. It also reliably avoids damage to the guide-channel 66. Another particular advantage is that, upon opening the door-element 6.8, water which has collected in the guide-channel 66 is urged, along the channel 66, towards the wall-element 2. As explained hereinafter, the guide-channel 66 ends below the wall-element 4 in such a manner that any water pushed back can drain freely into the shower-tub. Upon opening, the guide-channel 66 is automatically cleaned and this eliminates the danger of contamination or any accumulation of pathogens.

Figure 19:
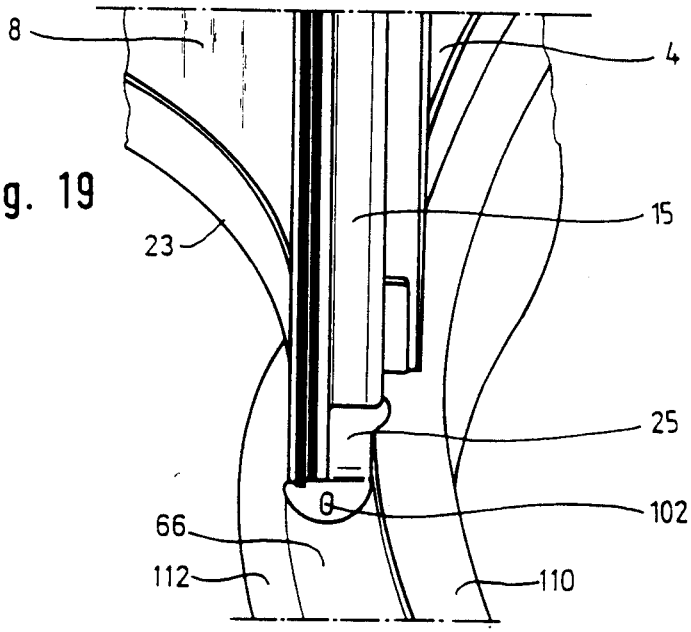
FIG. 19 is a view of the other door-element.

Like FIG. 18, FIG. 19 show a guide-element 25 which is located at the lower end of profiled rail 15 of the other door-element 8. The guide-element 25 contains a vertical slot 102 in which a guide-pin communicating with the brush is guided displaceably. The lower edge 23 of door-element 8 is arranged at a distance vertically above the inner edge 112 of the edge of the tub.

Figure 20:
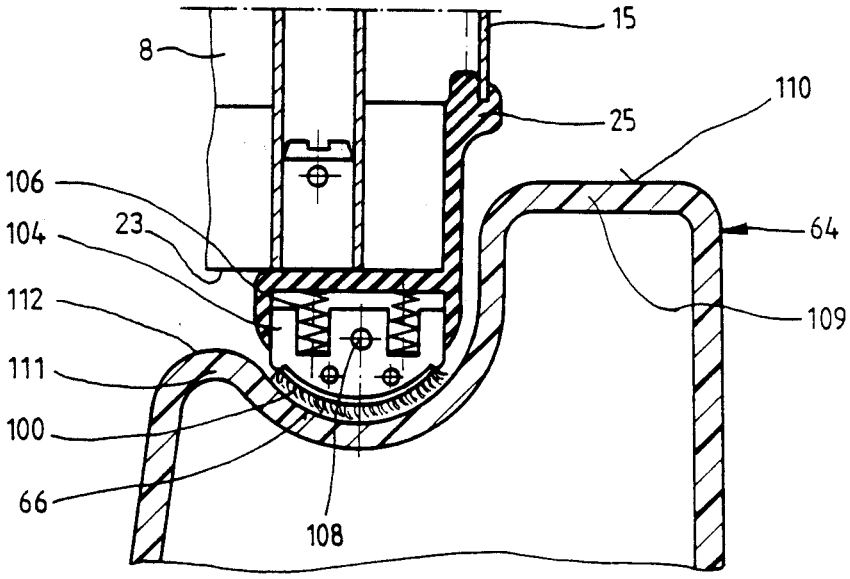
FIG. 20 is a section, in a vertical plane, through the lower guide-element.

FIG. 20 shows, in a vertical cutting plane, a section through the guide-element 25, the brush 100 being clearly visible. The brush is secured to a guide-part 104 which is supported resiliently in the guide-element by means of springs 106. Secured in a bore 108 of the guide-part 104 is the above-mentioned pin which engages in the slot 102 in guide-element 25. As seen looking from the outside towards the shower-tub, the guide-channel 66 is located behind and below the upper edge or top surface 110 of the front part or lip 109 of front wall portion 64. Adjoining the guide-channel 66, towards the interior of the shower-tub 17, there is an inner part or lip 111 having a convex top surface or inner edge 112. The inner edge 112 is lower than the horizontal upper edge 110 of the front part 109. The height of the raised inner lip 111 above the bottom of the guide channel 66 may be from 0.2 to 0.5 times the height of the raised outer lip 109 above the guide channel bottom. The lower edge 23 of the door-element 8 is at a predetermined vertical distance from the upper edge 112, so that the door-element 8 can be swung away over the upper edge 112. On the other hand, the lower edge 23 of the door-element 8, as seen in the vertical direction, is lower than the front upper edge 110, so that when the door-element is in the closed condition, splashes cannot escape. When the entrance-area 10 is open, the user can easily step over front wall portion 64 of the tub since the inner part 111 would not present any impediment. If the tub 17 is of plastic, made by the deep-drawing process, the design according to the invention, and the stepped contour, make it highly stable and rigid and the amount of material used is small.

FIG. 21 is a perspective view of the front wall portion 64 of the shower-tub 17. The guide-elements 25 of the door-elements 6,8 can easily be seen engaging in guide-channel 66.

FIG. 22 is a perspective view of the shower-tub 17 with the guide-channel 66, the latter being arranged between the higher front part 109 and the lower inner part 111. The guide-channel 66 does not extend over the entire length of the front edge 64 but ends, at a distance 114, before the outer edge or rear wall portion 116. However, the guide-channel 66 extends at least over the entrance-area, in order to permit guidance by means of the previously mentioned guide-elements 25. The inner part 111 comprises an end-area 118 where the inner edge drops vertically downwardly and, at the end 120, it is at level with the guide-channel 66. The two end-areas 118 are preferably located behind the respective wall-elements 2,4 whereas, in the entrance-area 10, the inner edge 112 of the inner part is arranged substantially horizontally. Thus, when the door-elements 6,8 are opened, any water in the guide-channel can be pushed back by the guide-elements 25, especially by the brush-elements 100 thereof and it can drain away unimpededly toward the end 120 and into the shower-tub 17, which automatically cleans out the guide-channel 66. In order that the water may drain away simply and reliably, the guide-channel 66 is inclined downwardly towards the ends 120 at a slight angle. The ends 120 are located substantially centrally of the bulges 22,24, the end-areas 118 being also associated with the bulges and being located behind the wall-elements 2,4.

Although, the invention was described hereinabove with a certain degree of particularity, it is understood that the present disclosure has been made only by way of example and that numerous changes in the details of construction and the combination and arrangement of parts may be resorted to without departing from the spirit and the scope of the invention as hereinafter claimed.

I claim:

1. A shower basin comprising a bottom and an upstanding outer margin surrounding said bottom, said outer margin having an integral, upwardly open, concave guide channel formed in a top surface thereof for guidingly receiving a lower guide element of a sliding shower door, said upstanding outer margin comprising a pair of straight rear wall portions forming a right angle with respect to each other and adapted to fit in a corner of a room, and a front wall portion extending between and joining said straight rear wall portions, said guide channel being formed in the top surface of said front wall portion, wherein said front wall portion has a wave-form shape comprising an outwardly bulging central entrance region and a pair of inward bulges arranged laterally of said entrance region.

2. A shower basin according to claim 1, wherein said guide channel 66 is said front wall portion is arranged between a raised outer lip and a raised inner lip formed integrally with said upstanding outer margin.

3. A shower basin according to claim 2, wherein said inner lip has ends adjacent said inward bulges and said guide channel slopes downwardly toward said ends of said inner lip and opens into the shower basin at said ends of said inner lip, whereby any water collected in said guide channel can flow to the ends of the channel and thence into said shower basin.

4. A shower basin according to claim 3, wherein said inner lip decreases in height toward its ends to a level corresponding to the bottom of said guide channel.

5. A shower basin according to claim 3, wherein said ends of said inner lip are each spaced a predetermined distance from the adjacent straight rear wall portion of said upstanding margin.

6. A shower basin according to claim 2, wherein said raised outer lip has a flat top surface, and said raised inner lip has a convex top surface.

7. A shower basin according to claim 6, wherein said convex top surface of said raised inner lip is lower than said flat top surface of said raised outer lip, but higher than a bottom surface of said guide channel.

8. A shower basin according to claim 7, wherein the height of said raised inner lip above the bottom of said guide channel is from 0.2 to 0.5 times the height of said raised outer lip above the bottom of said guide channel.

9. A shower basin according to claim 1, wherein said central entrance region extends substantially circularly through an angle of at least 90 degrees.

10. A shower basin according to claim 9, wherein said inner lip and said guide channel extend horizontally at least over said entrance region.

11. In combination, a shower basin according to claim 1, and a sliding shower door mounted for sliding movement along said guide channel, wherein said sliding door carries a lower guide element which is received in said guide channel, and said lower guide element comprises a vertically displaceable, flexible brush and means for resiliently biasing said brush against the bottom of said guide channel.

12. A shower basin comprising a bottom and an upstanding outer margin surrounding said bottom, said outer margin having an elongated, integral, upwardly open, concave guide channel formed in a top surface thereof for guidingly receiving a lower guide element of a sliding door to accommodate sliding movement of said door, wherein at least a portion of said guide channel slopes downwardly toward at least one end thereof and opens at said one end into the interior of the shower basin, whereby water collected in said portion of said guide channel can flow to said one end of the channel and thence into said shower basin.

13. A shower basin comprising a bottom and an upstanding outer margin surrounding said bottom, said outer margin having an undulating portion and an integral, upwardly open, concave guide channel formed in a top surface thereof for guidingly receiving a lower guide element of a sliding shower door, wherein said guide channel is formed in circular arc form in said top surface of said undulating portion of said outer margin of said shower basin and said guide channel is disposed between outer and inner raised lips on said upstanding outer margin of said shower basin, said inner lip being lower than said outer lip, and said guide channel having a bottom which is lower than said inner lip.

* * * * *